US007506493B2

(12) United States Patent
Zillmer

(10) Patent No.: US 7,506,493 B2
(45) Date of Patent: Mar. 24, 2009

(54) SAFETY STIRRUP

(76) Inventor: Peter Zillmer, 7 Grandview Drive, Coolum Beach, Queensland, 4573 (AU)

( * ) Notice: Subject to any disclaimer, the term of this patent is extended or adjusted under 35 U.S.C. 154(b) by 0 days.

(21) Appl. No.: 11/345,543

(22) Filed: Feb. 2, 2006

(65) Prior Publication Data

US 2006/0123742 A1 Jun. 15, 2006

Related U.S. Application Data

(63) Continuation-in-part of application No. 10/478,291, filed on Nov. 26, 2003, now abandoned.

(51) Int. Cl.
*B68C 3/00* (2006.01)

(52) U.S. Cl. ..... 54/49

(58) Field of Classification Search ..... 54/47, 54/49

See application file for complete search history.

(56) References Cited

U.S. PATENT DOCUMENTS

| | | | | |
|---|---|---|---|---|
| 219,608 | A | 9/1879 | Updegraff et al. | |
| 368,193 | A | 8/1887 | Collins | |
| 798,953 | A | 9/1905 | Eldenburg | |
| 908,265 | A | 12/1908 | Ivey | |
| 1,321,653 | A | 11/1919 | Luttinger | |
| 4,587,798 | A * | 5/1986 | Taylor | 54/49 |
| 5,826,413 | A * | 10/1998 | Bostock et al. | 54/49 |
| 6,698,169 | B1 * | 3/2004 | Bostock | 54/49 |

FOREIGN PATENT DOCUMENTS

| | | |
|---|---|---|
| AU | 62109/90 | 3/1991 |
| AU | 39191/95 | 10/1996 |
| DE | 2 003 387 | 7/1971 |
| WO | WO 97/49635 | 12/1997 |
| WO | WO 01/07358 | 2/2001 |

OTHER PUBLICATIONS www.dictionary.com definitions of tapered and beveled.*

* cited by examiner

*Primary Examiner*—Son T. Nguyen
(74) *Attorney, Agent, or Firm*—Hoffman, Wasson & Gitler

(57) ABSTRACT

The present invention provides a safety stirrup (1) comprising an inverted U-shaped mounting member (2) having an adaptation (7) in an arcuate portion (5) thereof for attachment of a stirrup strap thereto, a foot support (3) pivotally mounted between arms (4) of the mounting member (2) when the stirrup (1) is in normal use, wherein the foot support (3) comprises a tread (12) having an extension (13) projecting upwardly from each end of the tread (12), the distal ends of which extensions (13) join to form a loop (14). The stirrup (1) also has co-operating engagement means (25, 26) between the foot support (3) and the mounting member (2) to retain the loop (14) in a plane generally coincident with a central plane of the mounting member (2) when the stirrup (1) is in normal use. Rotation of the foot support (2) from the normal in use position disconnects the pivotal mountings and allows separation of the foot support (3) from the mounting member (2).

18 Claims, 8 Drawing Sheets

FIG. 1
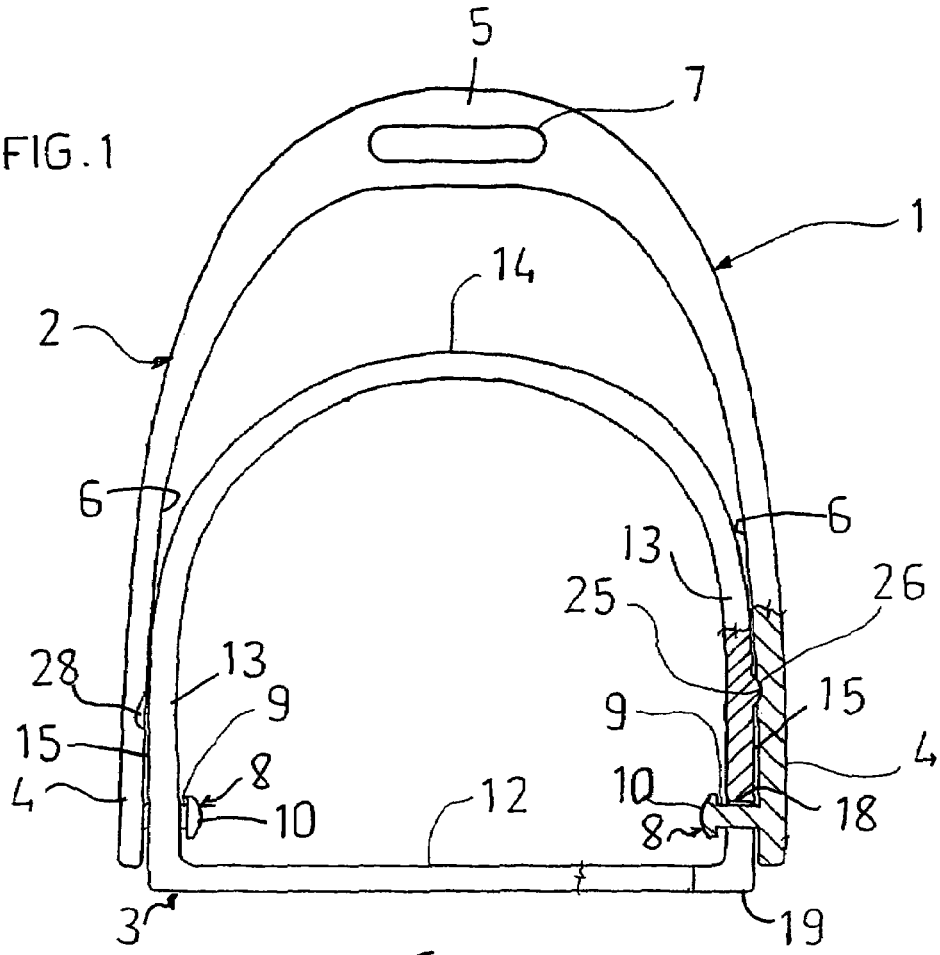
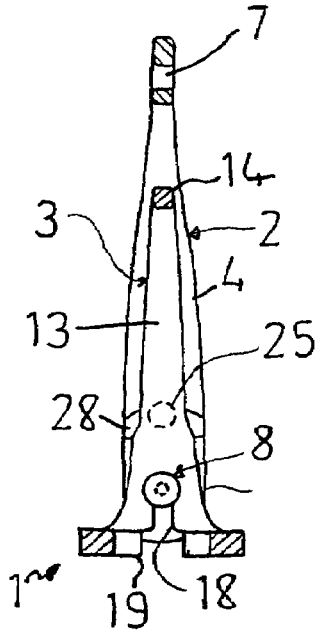
FIG. 2a
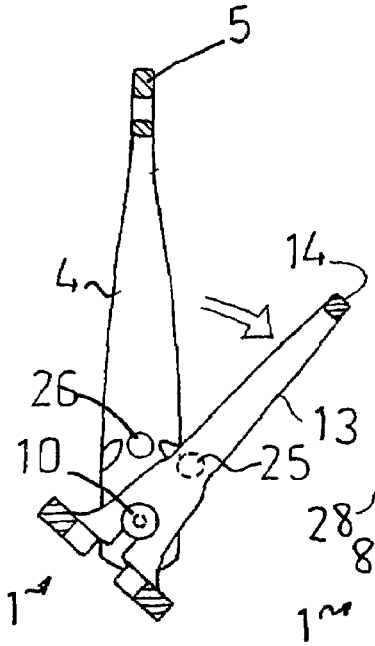
FIG. 2b
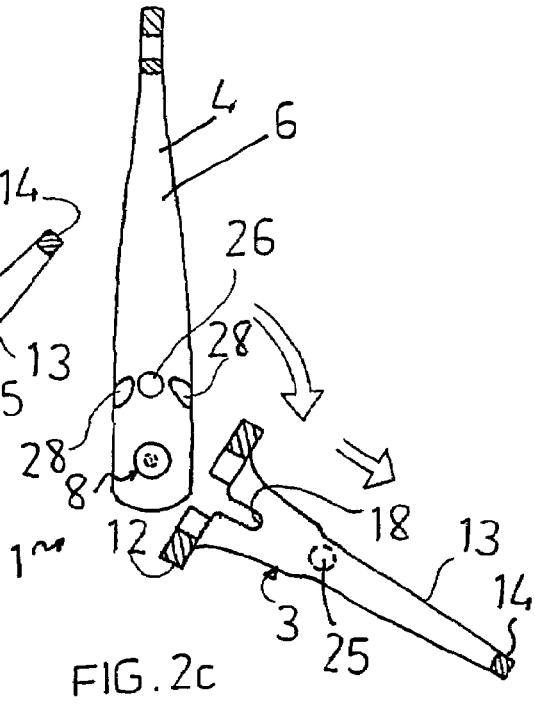
FIG. 2c

SAFETY STIRRUP

TECHNICAL FIELD

This application is a continuation-in-part of U.S. application Ser. No. 10/478,291 filed Nov. 26, 2003 now abandoned.

The invention relates to horse riding stirrups and is particularly concerned with safety stirrups, which prevent the rider's foot from being caught in the stirrup in the event of the inadvertent dismounting of the rider such as being thrown-from the horse.

BACKGROUND ART

Known types of stirrups generally include a D-shaped metal structure with a slot located in the centre of an intermediate arcuate portion of the D to enable the stirrup to be attached to a stirrup strap. In use, the rider's foot is inserted into the stirrup such that a base portion defined by an inner surface of the upright of the D of the stirrup locates against the sole of the rider's foot and the arcuate portion of the stirrup locates against the top of the rider's foot. In this way the rider's foot is held in place and is not easily dislodged from the stirrup when the gait of the horse increases.

A disadvantage of existing stirrups is that in the event of the rider falling from the saddle, one of the rider's feet can become caught in the stirrup. This is particularly the case when a rider is thrown from the horse, the swiftness of which does not allow the rider to extract a foot caught in a stirrup. Catching of a foot in a stirrup can cause serious injury or even death since the rider may be dragged along the ground beside the horse.

Safety stirrups have been devised to overcome the foregoing disadvantage of the common type of stirrup. One form of a safety stirrup includes a frangible or weakened portion of the stirrup located adjacent to the stirrup strap attachment slot. In use, this frangible portion is designed to break away if the rider's foot is caught in the stirrup when the rider is thrown from the saddle.

This frangible stirrup is satisfactory in that the rider is saved from injury, which may be caused by being dragged along the ground. However, the rider cannot easily remount, since the saddle now has only one operable stirrup, which increases the chance of the rider being thrown from the saddle should the horse increase its gait. Hence the rider should replace the broken frangible stirrup before continuing, which may be inconvenient or impossible.

A safety stirrup of the type including a frangible portion often does not prevent the rider from suffering leg injuries when the rider is thrown from the horse. Hence, they are only of limited benefit for novice or disabled riders. A further disadvantage of these stirrups is that they are more bulky than conventional stirrups in the region of attachment to the stirrup strap and this increased bulk often causes wear to the rider's clothing.

An alternative form of safety stirrup is disclosed in Australian Patent Application No. 62109/90. In this stirrup, the foot is held in a restraint, which separates when the restraint is pivoted out of the normal in use position of the restraint with a rider mounted on a horse. This pivoting will occur when the rider is thrown from the horse and the separation of the restraint results in release of the foot from the stirrup. A disadvantage of the stirrup described in AU 62109/90 is that a foot must be placed in the stirrup from a particular side for the release mechanism to operate. Use of the stirrup with the foot inserted from the wrong side prevents operation of the release mechanism.

Yet another form of safety stirrup is disclosed in International Application Number PCT/AU97/00398 (Publication No. WO 97/49635) which is a combination of the AU 62109/90 stirrup and a safety stirrup described in International Application No. PCT/AU95/00332 (Publication No. WO 96/00185) by the present applicant. While PCT/AU95/00332 provides a safety stirrup that can be used with a foot inserted from either side, the PCT/AU97/00398 stirrup has the same failing as the AU 62109/90 stirrup in that the foot must be placed in the stirrup from a particular side for the release mechanism to work.

SUMMARY OF THE INVENTION

It is an object of the present invention to provide a stirrup which alleviates or overcomes the disadvantages of existing stirrups, or provides an alternative to known stirrups.

According to the present invention there is provided a safety stirrup comprising:

a mounting member having arms, an intermediate portion extending between the arms and an adaptation in the intermediate portion for attachment of a stirrup strap thereto;

a foot support pivotally mounted between the arms when the stirrup is in normal use, wherein the foot support comprises a tread having an extension projecting upwardly from each end of the tread, the distal ends of which extensions join to form a loop;

co-operating engagement means between the foot support and the mounting member to retain the loop of said foot support in a plane generally coincident with a central plane of the mounting member when the stirrup is in said normal use;

wherein rotation alone of said foot support from said normal in use position, in either direction relative to the mounting member, initiates disengagement of the foot support from the mounting member.

The term "normal use" is used in the preceding paragraph and hereafter to denote the configuration of the stirrup when a rider is mounted on a horse to which a pair of stirrups is fitted with each foot of the rider in respective stirrups of the pair. In this configuration, the foot support is retained within the mounting member by the co-operating engagement means in combination with the pivotal mounting of the foot support to the mounting member. The configuration allows the rider to perform all actions required of horse riding including standing in the stirrups.

On the rider falling or being thrown from the horse, a foot caught in the stirrup causes the foot support to rotate by pressure on the loop of the support. There is an opposite force on the mounting member via the stirrup strap, which is still attached to a saddle on the horse. The rotation of the foot support causes the support to separate from the mounting member thereby releasing the rider's foot from the stirrup.

Disengagement of the foot support from the mounting member can occur regardless of whether the rotation of the loop is in a forward direction or reverse direction relative to the central plane of the mounting member. In this way, the safety stirrup can be used with a foot inserted from either side.

The mounting member can be of any suitable size, shape and construction. Typically, the mounting member will be an inverted U-shape and the stirrup strap will be attachable to an arcuate intermediate portion of the mounting member. Each arm can have an inner face facing the foot support.

The adaptation in the intermediate portion can be a conventional arrangement such as a slot through which the stirrup strap is threaded, or a known toggle-type connection. The former arrangement is preferred.

The foot support can be of any suitable size, shape and construction. The tread of the foot support can be in the form of a solid plate or slotted plate, which is oriented in a generally horizontal plane in normal use. Preferably, the extensions are walls which are integrally formed with the ends of the tread. Each extension can have an outer face facing a respective arm of the mounting member.

The foot support can include a foot grip extending along the tread. The grip can be made, for example, of rubber.

The foot support can be pivotally mounted to the mounting member in any suitable way mounting. This can be achieved, for example, by way of shafts and apertures for receiving the shafts. Shafts can extend from the arms of the mounting member and can be received by apertures in the foot support. For example, a shaft projecting from the inner face of the arm of the support member can be received by an aperture in the extension or tread of the foot support. Alternatively, shafts can extend from the foot support at or near the ends of the tread and can be received by apertures in the arms. Preferably, shafts extend from outer faces of the foot support. For example, a shaft projecting from the outer face of the extension or tread can be received by an aperture in the arm of the mounting member.

To allow separation of the foot support and the mounting member on rotation of the former, the aperture can extend to an edge of the component having the aperture. Typically, the aperture, in the form of a slot or slit, will extend to a bottom edge of the foot support (extension or tread). On rotation of the foot support to a sufficient degree with force applied to the foot support away from the mounting member, the shaft can move along the aperture to effect disengagement of the foot support and the mounting member.

The shaft and aperture can be configured such that disengagement only occurs upon the loop rotating through a predetermined angle relative to the central plane of the mounting member. For instance, the shaft and aperture can be configured such that the foot support can immediately disengage the mounting member upon the loop rotating from the central plane of the mounting member. In order to achieve this, the width of the aperture (slot or slit) will be greater than a diameter of the shaft.

The shaft and aperture can be, for instance, configured such that the foot support can only disengage the mounting member upon the loop rotating from the central plane of the mounting member through an predetermined angle of, say, about 90 degrees. In order to achieve this, the aperture can have a constriction, the shaft can have a pair of diametrically opposed longitudinally extending flat faces, and the shaft can only pass through the constriction when the flat faces are in proper alignment with the constriction. If the loop is rotated through other angles, say 180 degrees relative to the normal in use position, the shaft can be retained within the aperture and the foot support can serve as a step for a rider when, say, mounting the horse.

The pivotal mounting preferably comprises the shafts and enlarged heads at the ends thereof that prevent excessive spreading of the arms of the mounting member when the shafts are located in the apertures of the other component of the stirrup. Advantageously, the heads stand slightly away from the adjacent surfaces of the component with apertures to provide gaps therebetween when the shafts are located in the apertures. Depending on the nature of the co-operating engagement means between the foot support and the mounting member, the aforementioned gaps can facilitate disengagement of the foot support and the mounting member by allowing spreading of the arms of the mounting member.

In preferred embodiments where the pivotal mounting of the foot support to an arm of the mounting member includes a shaft having a head, a recess is typically provided around the corresponding aperture, which recess can receive the head when the shaft is located in the aperture. The bulk of the head advantageously lies within the recess resulting in the component having a substantially smooth surface.

The co-operating engagement means can be any suitable arrangement. The co-operating engagement means can comprise at least one projection formed on the foot support and at least one aligned socket formed in at least one arm of the mounting member. The projection and socket can be of any suitable size and shape. For instance, the projection can be hemispherical, wedge-shaped, elongate or in the shape of a truncated pyramid. Alternatively, or additionally, at least one projection can be formed on at least one arm of the mounting member and at least one corresponding socket can be formed in the foot support. The projection is suitably maintained within the socket to thereby prevent pivotal rotation of the loop from the central plane of the mounting member during normal use, by spring-biasing the arms of the mounting member against the restraining means. A projection can be formed on the inner face of each arm and a socket can be formed in the outer face of each extension of the foot support. Alternatively or additionally, a projection can be formed on the outer face of each extension and a socket can be formed in the inner face of each arm.

The components of a stirrup according to the invention can be fabricated from any suitable material including metals, metal alloys and plastics materials. Preferred metals are aluminium and stainless steel while a preferred plastics material is carbon fibre.

Having broadly described the invention, safety stirrups will now be exemplified with reference to the accompanying drawings briefly described hereafter.

BRIEF DESCRIPTION OF THE DRAWINGS

FIG. 1 is an elevational view of a safety stirrup according to an embodiment of the present invention with a partial cross-section at the lower right-hand corner of the drawing;

FIGS. 2*a* to 2*c* are cross-sectional end elevations of the stirrup shown in FIG. 1 with the cross-section at a vertical plane through the centre of the stirrup;

BEST MODE AND OTHER MODES OF CARRYING OUT THE INVENTION

Figure 3:
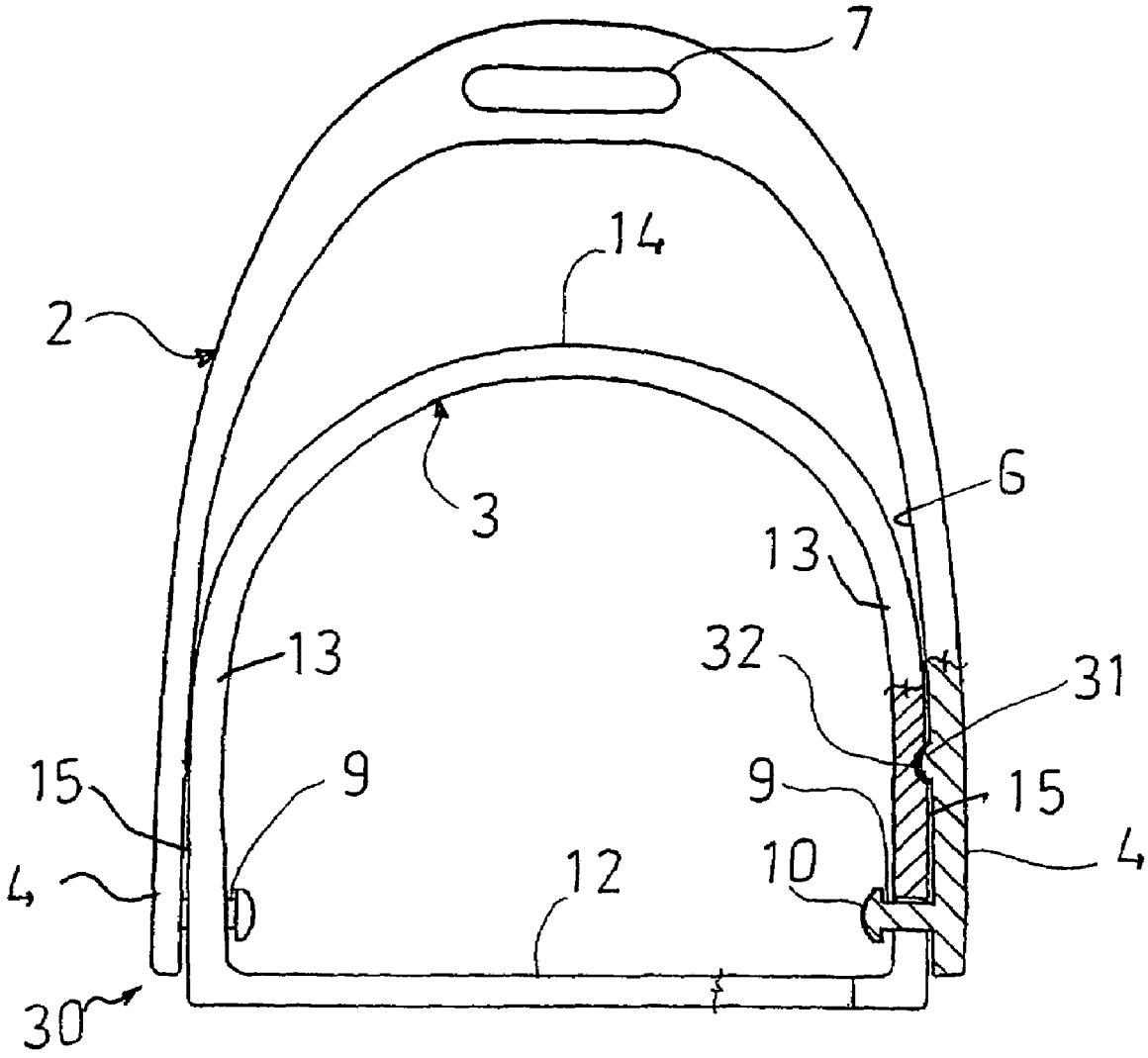
FIG. 3 is an elevational view of a safety stirrup according to another embodiment of the present invention with a partial cross-section at the lower right-hand corner of the drawing.

In the figures, like reference numerals refer to like features.

With reference to FIGS. 1 and 2*a* to 2*c*, there is shown a safety stirrup 1 comprising a mounting member 2, a foot support 3 pivotally mounted to the mounting member 2, and co-operating engagement means 25, 26 between the foot support 3 and the mounting member 2. The stirrup 1 is made of metal or plastics material.

The mounting member 2 is U-shaped and includes a pair of arms 4 as well as an arcuate portion 5 intermediate the arms 4. Each arm 4 has an inner face 6. A slot 7 for a stirrup strap extends within the intermediate arcuate portion 5. A pin 8, having a cylindrical shaft 9 and an enlarged head 10 at the end thereof, extends from the inner face 6 of each arm 4.

The foot support 3 has a tread 12 and extensions 13 that extend upwardly from opposing ends of the tread 12. The extensions 13 meet to form a loop 14 above the tread 12. The extensions 13 are adjacent opposing ends of the tread 12 and are expanded to essentially form a wall. Each extension 13 has an outer face 15. Each extension 13 has an elongate aperture 18 (slot) that extends to a bottom edge 19 of the foot support 3 at the ends of the tread 12. Each shaft 9 extends through a respective aperture 18, as best seen in FIGS. 1 and 2*c*. The diameter of the shaft 9 is smaller than the width of the aperture 18.

Although not shown in the drawings, if desired, the apertures 18 could be located in the arms 4 of the mounting member 2 and the shafts could extend from the tread 12 or extensions 13 of the foot support 3.

The co-operating engagement means 25, 26 between the foot support 3 and the mounting member 2 retain the loop 14 of the foot support 3 in a plane generally coincident with a central plane of the mounting member 2, as seen in FIGS. 1 and 2*a*. The co-operating engagement means 25, 26 comprises a hemispherical projection 25 on the outer face 15 of each extension 13 and a socket 26 formed in the inner face 6 of each arm 4. The arms 4 are spring-biased towards each other and hold each projection 25 in its corresponding socket 26, thereby locking the foot support 3 in place.

A pair of grooves 28 are formed in the inner face 6 of each arm 4 and one groove 28 is located each side of the socket 26. The grooves 28 extend to opposing edges of the inner faces 6. Following disengagement, these grooves 28 aid rotation of the foot support 3 back into the locked position in that the hemispherical projections 25 are able to travel within the grooves 28.

Operation of the safety stirrup 1 is shown in FIGS. 2*a* to 2*c*. The normal in use configuration of the stirrup 1 is shown in FIG. 2*a* whereby the loop 14 of the foot support 3 is in a plane generally coincident with the central plane of the mounting member 2 and the pins 8 are retained within the apertures 18. The foot support 3 is releasably locked in this position by docking of the projections 25 in the sockets 26.

The initial stage of separation of the foot support 3 from the mounting member 2 on a rider falling from a horse carrying the stirrup 1 with a foot caught therein is shown in FIG. 2*b*. The pressure of the rider's foot against the loop 14 causes the projections 25 to disengage from the sockets 26 and for the loop 14 to rotate away from the central plane of the mounting member 2, as generally indicated by the curved arrow.

Completion of the separation process is shown in FIG. 2*c*. Once the loop 14 has rotated from the central plane of the mounting member 2, the shafts 9 are free to slide through the apertures 18 such that the foot support 3 can separate from the mounting member 2, as generally shown by the straight arrow. The rider's foot is then released from the stirrup 1. Usually this will occur upon rotation of the loop 14 more than about 90 degrees relative to the central plane of the mounting member 2. Reassembly of the stirrup is a reversal of the release sequence depicted in FIGS. 2*a* to 2*c*.

Disengagement of the foot support 3 from the mounting member 2 (or reassembly of the foot support 3 with the mounting member 2) can occur regardless of whether rotation of the loop 14 is in a forward direction or reverse direction relative to the central plane of the mounting member 2. In this way, the stirrup 1 can be used with a foot inserted from either side.

A safety stirrup 30 according to another embodiment of the invention is shown in FIG. 3. Safety stirrup 30 is essentially the same as stirrup 1 except with regard to the co-operating engagement means 31, 32. In stirrup 30, the co-operating engagement means 31, 32 comprises a hemispherical projection 31 on the inner face 6 of each arm 4 of the support member 2. The projections 31 dock in sockets 32 provided in the outer face 15 of each extension 13 of the foot support 3. Operation of the stirrup 30 and reassembly thereof is essentially the same as for stirrup 1 (as shown in FIGS. 2*a* to 2*c*) except that grooves 28 are lacking as they are not required.

A safety stirrup 40 according to yet another embodiment of the invention is shown in FIGS. 4 to 9. The stirrup 40 comprises a mounting member 41, a foot support 42 pivotally mounted to the mounting member 41, and co-operating engagement means 65, 66 between the foot support 42 and the mounting member 41. The stirrup 40 is made of plastics material.

Figure 9:
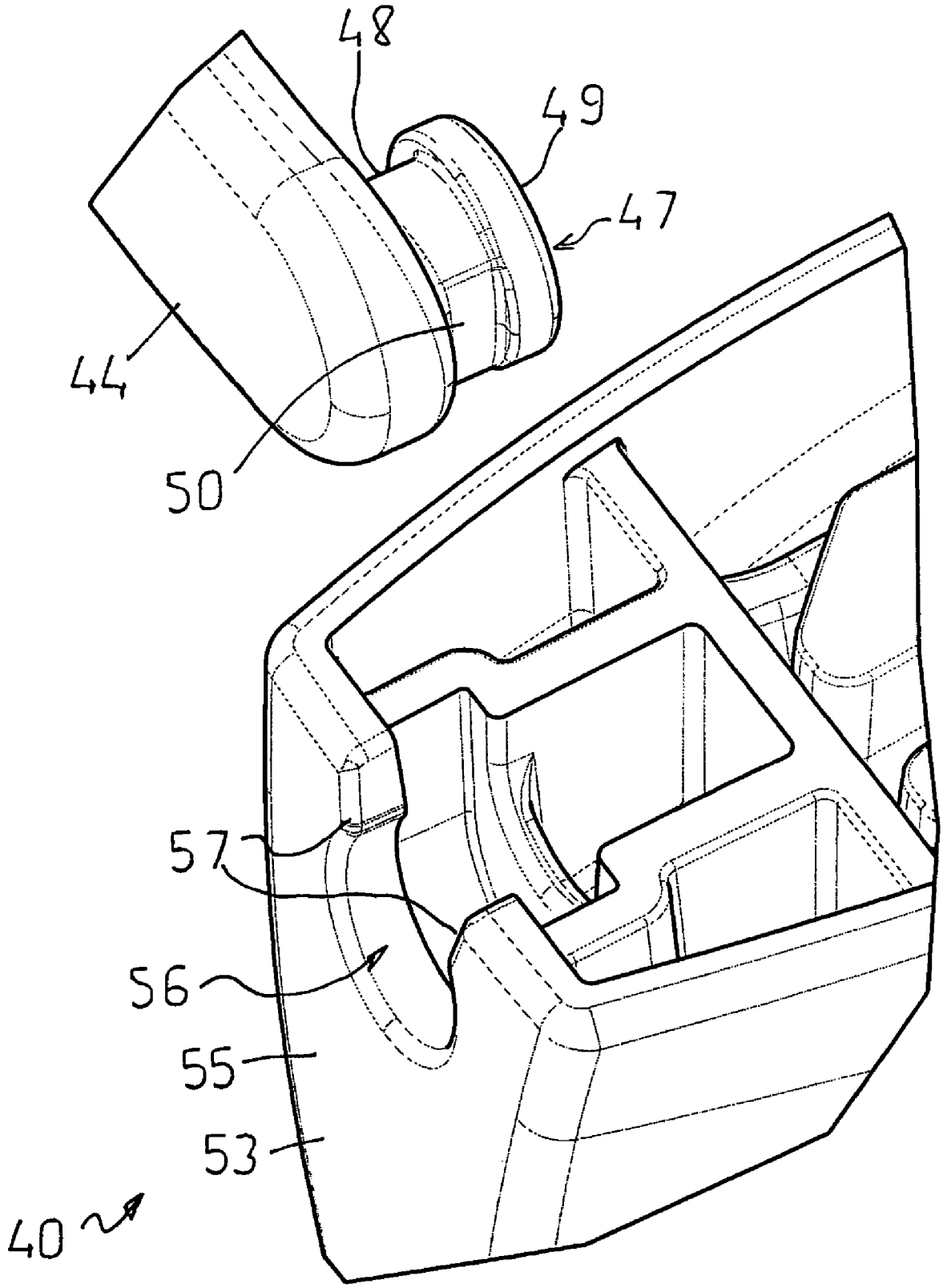
FIG. 9 is detailed view of part of the safety stirrup shown in FIG. 8.

The mounting member 41 includes a pair of arms 44 as well as an intermediate portion 45 extending between the arms 44. Each arm 44 has an inner face 46 (shown in FIG. 7). A slot 43 (shown in FIG. 7) for a stirrup strap extends within the intermediate portion 45. A pin 47, having a shaft 48 and an enlarged head 49 at the end thereof, extends from the inner face 46 of each arm 44. Each shaft 48 is generally cylindrical but has a pair of diametrically opposed longitudinally extending flat faces 50, as best seen in FIG. 9.

Figure 5:
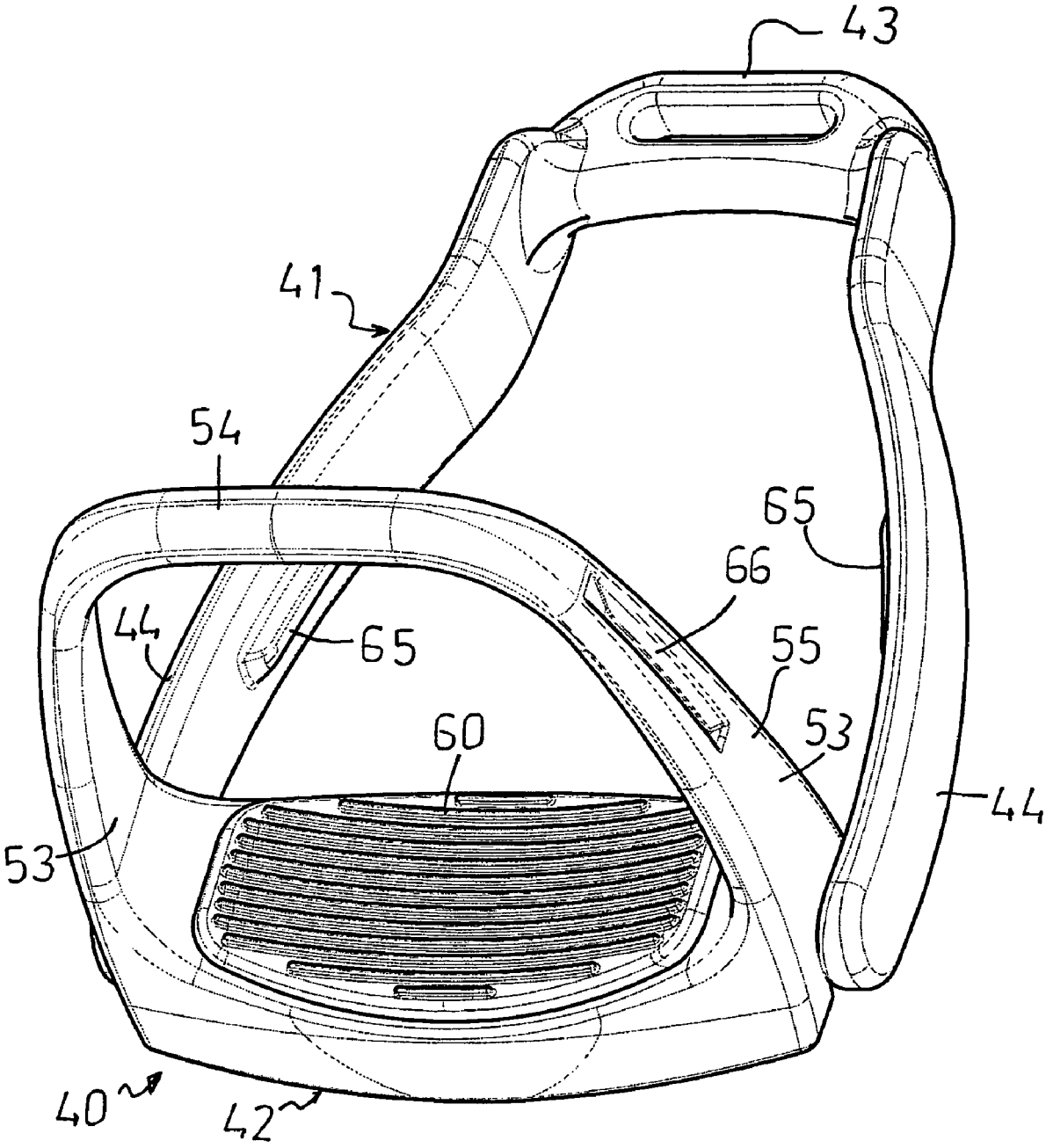
FIG. 5 is a perspective view of the safety stirrup shown in FIG. 4.
Figure 6:
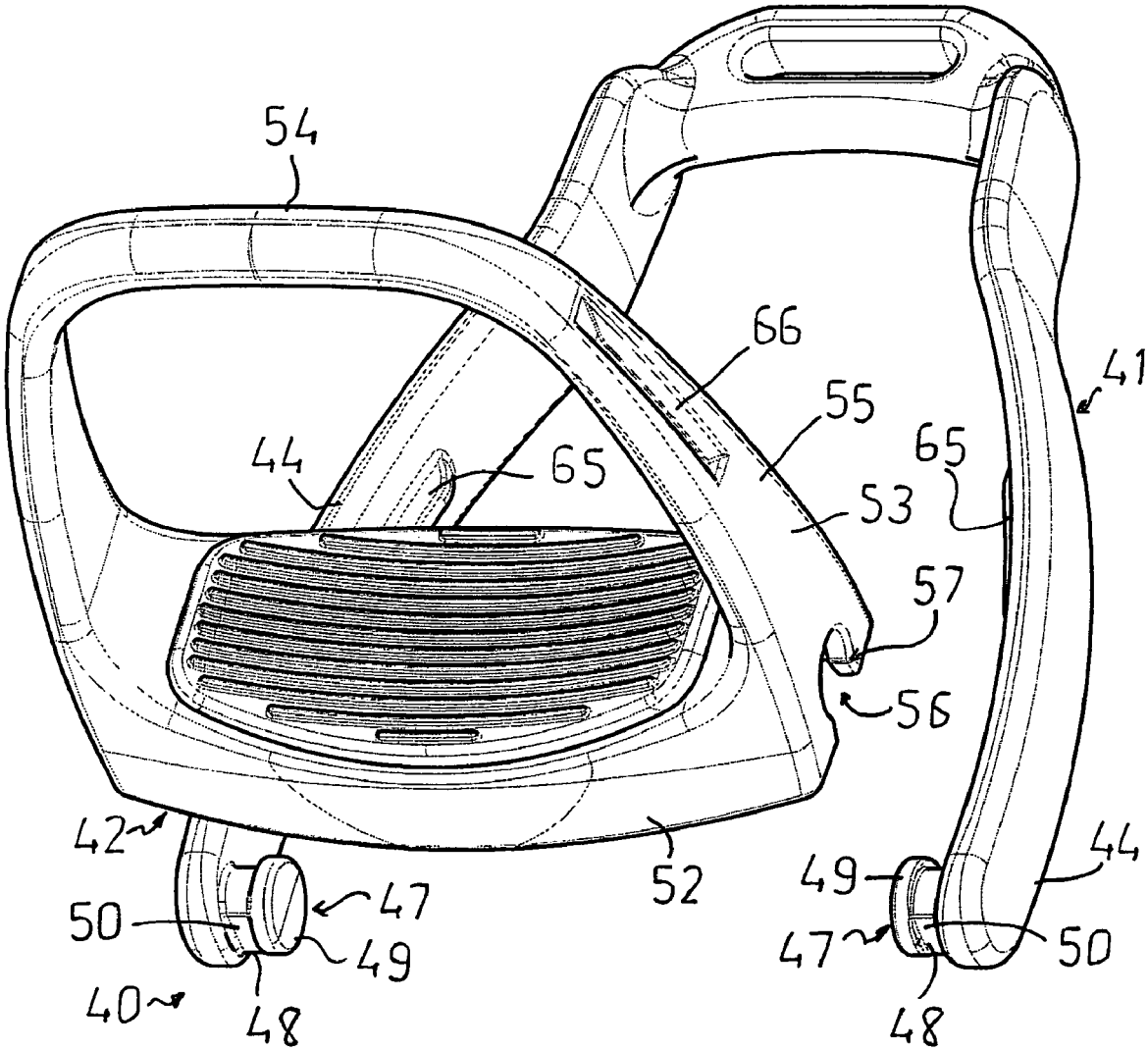
FIG. 6 is an exploded perspective view of the safety stirrup shown in FIG. 5.
Figure 7:
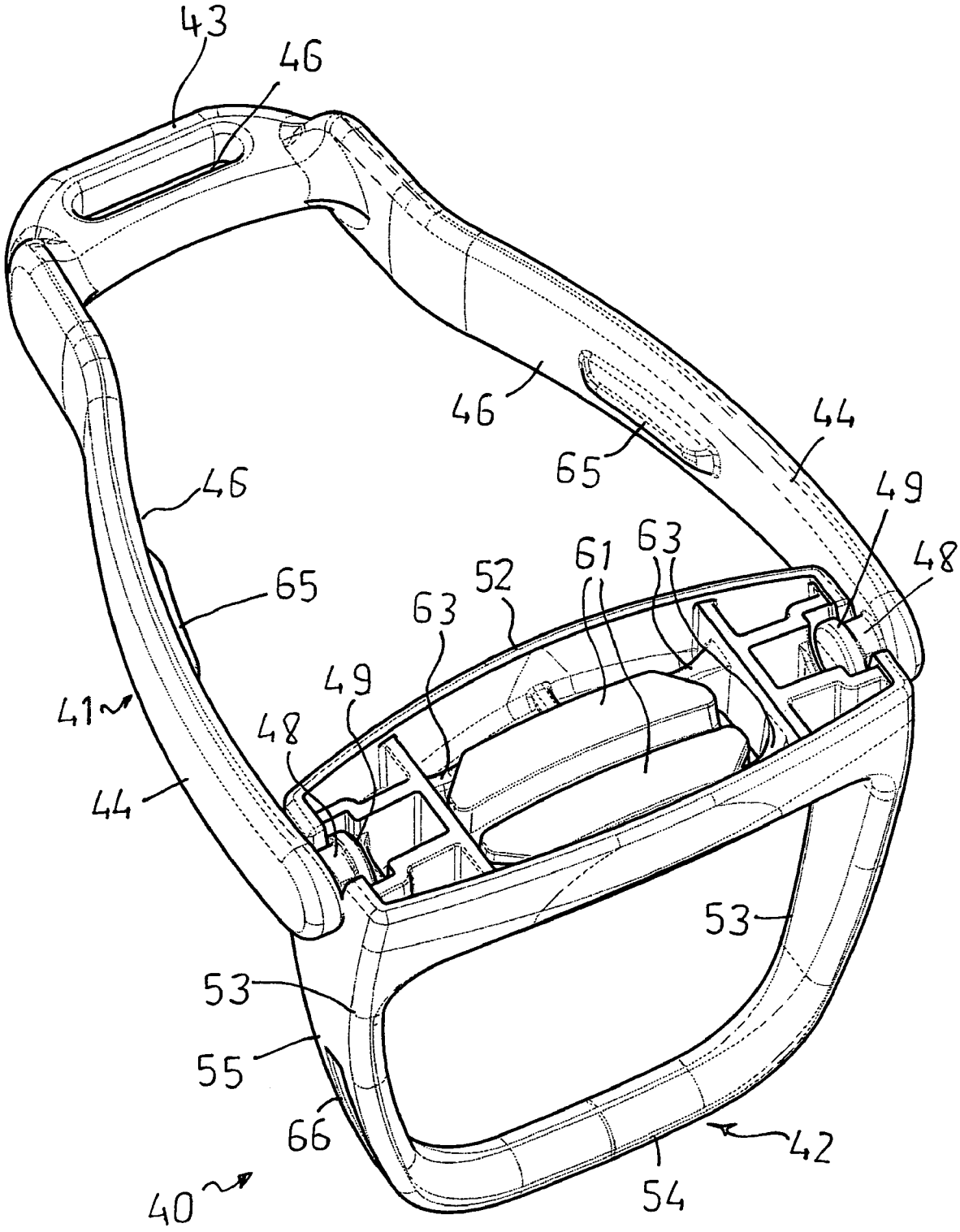
FIG. 7 is another perspective view of the safety stirrup shown in FIG. 5.
Figure 8:
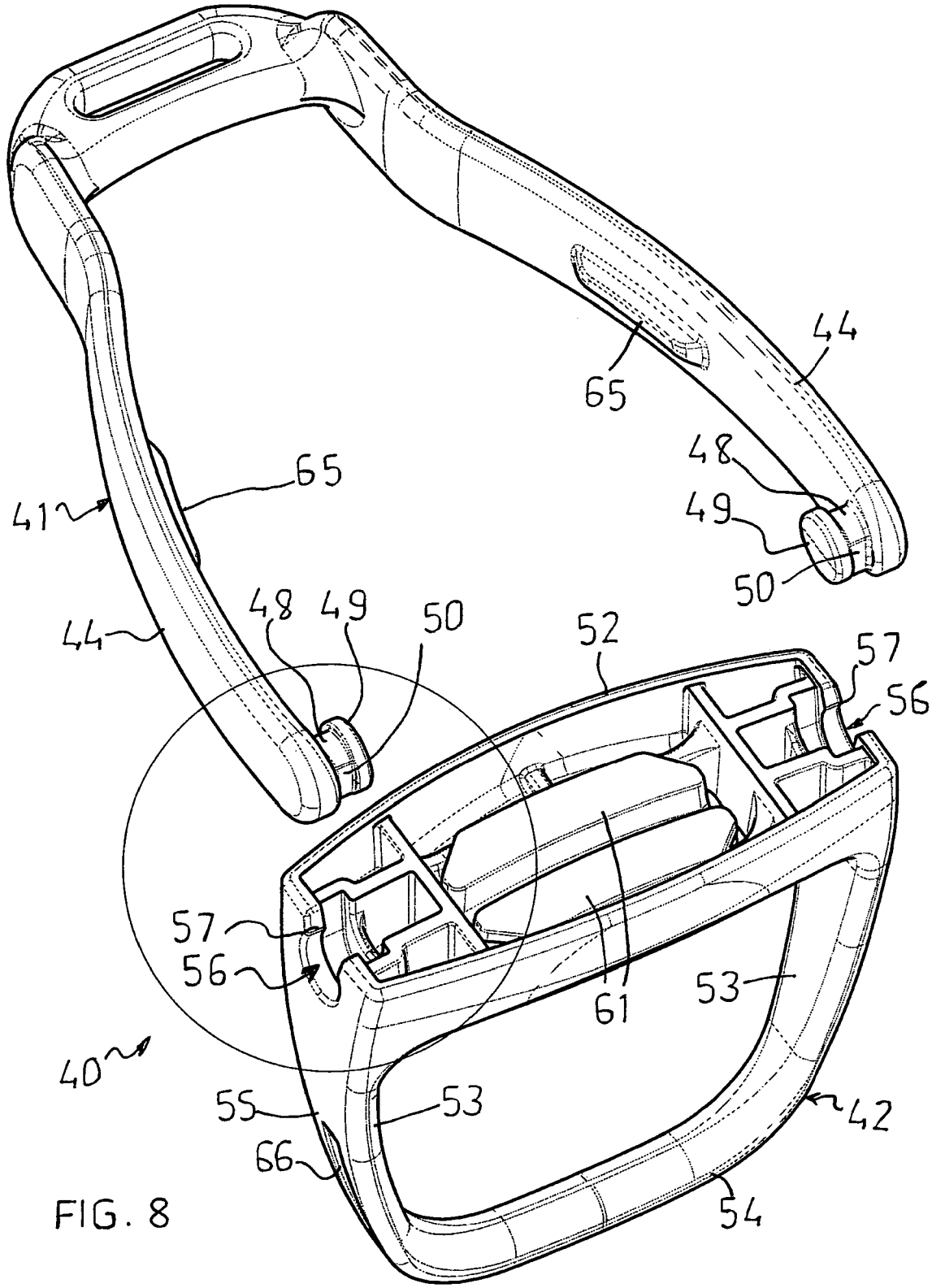
FIG. 8 is an exploded perspective view of the safety stirrup shown in FIG. 7.

The foot support 42 has a tread 52 and extensions 53 that extend upwardly from opposing ends of the tread 52. The extensions 53 meet to form a loop 54 above the tread 52. Each extension 53 has an outer face 55. Each extension has a substantially keyhole-shaped aperture 56 (slot) at an end of the tread 52. Each aperture 56 has a constriction/narrowing 57. Each aperture 56 extends to a bottom edge of the foot support 42 at an end of the tread 52. Each shaft 48 extends through a respective aperture 56. The shaft 48 can only pass through the constriction when the flat faces 50 are in proper alignment with the constriction 57, as shown in FIGS. 5 and 7. A rubber foot grip 60 extends through an elongate opening in the tread 52. Hooked portions 61 of the grip 60 lock behind webbing 63 of the tread 52, as seen in FIG. 7.

The co-operating engagement means 65, 66 between the foot support 42 and the mounting member 41 retain the loop 54 of the foot support 42 in a plane generally coincident with a central plane of the mounting member 41. The co-operating engagement means 65, 66 comprises a tapered elongate projection 65 (like a truncated pyramid) on the inner face 46 of each arm 44 and a similarly shaped socket 66 formed in the outer face 55 of each extension 53. The arms 44 of the mounting member 41 are spring-biased towards each other and hold each projection 65 in its corresponding socket 66, thereby locking the foot support 42 in place.

Figure 4:
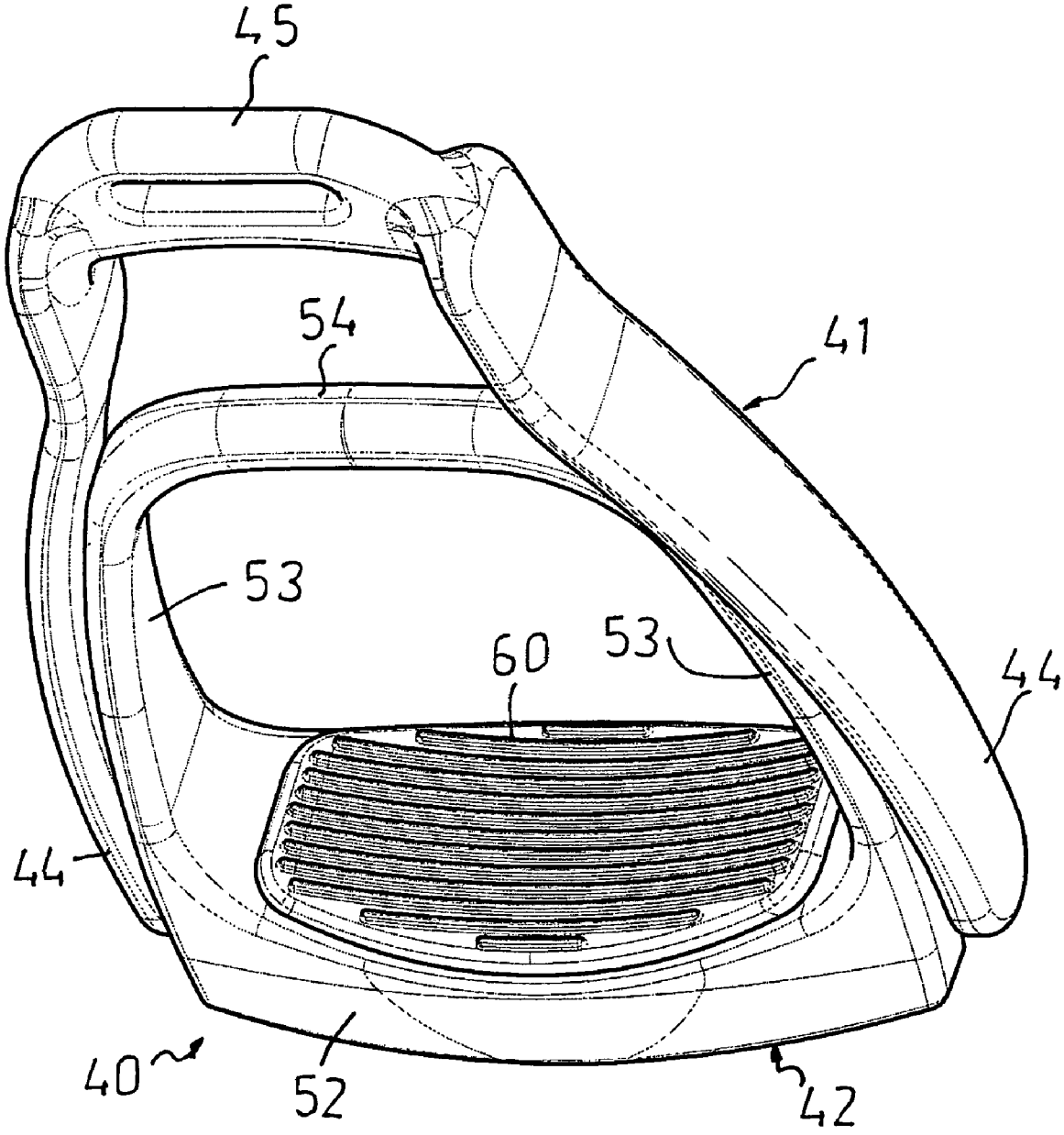
FIG. 4 is a perspective view of a safety stirrup according to another embodiment of the present invention.

The normal in use configuration of the stirrup 40 is shown in FIG. 4 whereby the loop 54 of the foot support 42 is in a plane generally coincident with the central plane of the mounting member 41. When a rider falls from a horse, the pressure of the rider's foot against the loop 54 causes the projections 65 to disengage from the sockets 66 and for the loop 54 to rotate away from the central plane of the mounting member 41.

Once the loop 54 has rotated about 90 degree from the central plane of the mounting member 41, the shafts 48 are able to pass through the apertures 56 such that the foot support 42 can separate from the mounting member 41. When doing so, the flat faces 50 of the shaft 48 extend parallel with the longitudinal axis of the aperture 56. The rider's foot is then released from the stirrup 40. Reassembly of the stirrup 40 is a reversal of the release sequence.

As already mentioned, the shaft 48 can only pass through the constriction 57 when the flat faces 50 are in proper alignment with the constriction 57, which is about 90 degrees or 270 degrees relative to the normal in use position. If turned through other angles, say 180 degrees relative to the normal in use position, then the shaft 48 will be retained within the aperture 56.

Disengagement of the foot support 42 from the mounting member 41 (or reassembly of the foot support 42 with the mounting member 41) can occur regardless of whether rotation of the foot support 42 is in a forward direction or reverse direction relative to the central plane of the mounting member 41. In this way, the stirrup 40 can advantageously be used with a foot inserted from either side.

Another advantage of the present invention is that rotation alone of the foot support from the normal in use position is enough to initiate disengagement of the foot support from the mounting member.

Yet another advantage of the present invention, as embodied in FIGS. 1 to 3, is that the foot support 3 can potentially disengage the support member 2 immediately upon the loop 14 rotating from the central plane of the support member 2.

Yet another advantage of the present invention, as embodied in FIGS. 4 to 9, is that the foot support 42 can serve as a step for a rider mounting the horse. That is, the foot support 42 can remain in engagement with the support member 41 if the loop 54 is made to extend about 180 degrees relative to the normal in use position and the foot support 42 can serve as a step.

It will be appreciated by one of skill in the art that many changes can be made to the safety stirrup as exemplified above without departing from the broad ambit and scope of the invention.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. A safety stirrup comprising:

a mounting member having arms, an intermediate portion extending between the arms and an adaptation in the intermediate portion for attachment of a stirrup strap thereto;

a foot support pivotally mounted between the arms when the stirrup is in normal use, wherein the foot support comprises a tread having an extension projecting upwardly from each end of the tread, the distal ends of which extensions join to form a loop;

co-operating engagement means between the foot support and the mounting member to retain the loop of said foot support in a plane generally coincident with a central plane of the mounting member when the stirrup is in said normal use;

wherein rotation of said foot support from said normal in use position, in either direction relative to the mounting member, without any initial vertical movement of the foot support relative to the mounting member prior to said rotation, initiates full disengagement of the foot support from the mounting member.

2. The stirrup according to claim 1, wherein said pivotal mounting is by way of shafts and apertures within which said shafts extend.

3. The stirrup according to claim 2, wherein said shafts extend from inner faces of said arms of said mounting member.

4. The stirrup according to claim 3, wherein said shafts are received by said apertures in said foot support near or at opposing ends of said tread, and wherein said apertures extend to an edge of said foot support to allow disengagement of said foot support on rotation thereof.

5. The stirrup according to claim 2, wherein said shafts extend from outer faces of said foot support at or near opposing ends of said tread.

6. The stirrup according to claim 5, wherein said shafts are received by said apertures in said arms of said mounting member, and wherein said apertures extend to an edge of said arms to allow disengagement of said foot support on rotation thereof.

7. The stirrup according to claim 2, wherein said shafts have heads at the ends thereof which limit spreading of said arms of said mounting member.

8. The stirrup according to claim 7, wherein said heads are each received in a recess.

9. The stirrup according to claim 2, wherein said shafts and said apertures are configured such that disengagement only occurs upon the loop rotating through a predetermined angle relative to the central plane of the mounting member.

10. The stirrup according to claim 9, wherein each said aperture has a constriction, each said shaft has a pair of diametrically opposed longitudinally extending flat faces, and said shaft can only pass through said constriction when said flat faces are in proper alignment with said constriction.

11. The stirrup according to claim 10, wherein said shafts can pass through said constrictions when said loop has rotated about 90 degrees relative to the central plane of the mounting member, and wherein said shafts are retained within said apertures when said loop has rotated about 180 degrees relative to the central plane of the mounting member.

12. The stirrup according to claim 1, wherein said co-operating engagement means comprises a projection on each said extension of said foot support and a socket in each said arm of said mounting member with which said projection is aligned when said stirrup is in normal use.

13. The stirrup according to claim 12, wherein each said projection is substantially hemispherical.

14. The stirrup according to claim 1, wherein said co-operating engagement means comprises a projection on each said arm of said mounting member and a socket in each said extension of said foot support with which said projection is aligned when said stirrup is in normal use.

15. The stirrup according to claim 14, wherein each said projection is substantially in the shape of a truncated pyramid.

16. A safety stirrup comprising:

a mounting member having arms, an intermediate portion extending between the arms and an adaptation in the intermediate portion for attachment of a stirrup strap thereto;

a foot support pivotally mounted between the arms when the stirrup is in normal use, wherein the foot support comprises a tread having an extension projecting upwardly from each end of the tread, the distal ends of which extensions join to form a loop;

co-operating engagement means between the foot support and the mounting member to retain the loop of said foot support in a plane generally coincident with a central plane of the mounting member when the stirrup is in said normal use;

wherein full disengagement of the foot support from the mounting member begins with rotation of said foot support from said normal in use position, in either direction relative to the mounting member, without any initial vertical movement of the foot support relative to the mounting member prior to said rotation.

17. A safety stirrup comprising:

a mounting member having arms, an intermediate portion extending between the arms and an adaptation in the intermediate portion for attachment of a stirrup strap thereto;

a foot support pivotally mounted between the arms when the stirrup is in normal use, wherein the foot support comprises a tread having an extension projecting upwardly from each end of the tread, the distal ends of which extensions join to form a loop, wherein said pivotal mounting is by way of shafts and apertures within which said shafts extend; and co-operating engagement means between the foot support and the mounting member to retain the loop of said foot support in a plane generally coincident with a central plane of the mounting member when the stirrup is in said normal use, wherein rotation of said foot support from said normal in use position, in either direction relative to the mounting member, without any initial vertical movement of the foot support relative to the mounting member prior to said rotation, initiates full disengagement of the foot support from the mounting member, and wherein said shafts and said apertures are configured such that there is no said initial vertical movement of the foot support relative to the mounting member and disengagement only occurs upon the loop rotating through an angle of about 90 degrees relative to the central plane of the mounting member.

18. A safety stirrup comprising:

a mounting member having arms, an intermediate portion extending between the arms and an adaptation in the intermediate portion for attachment of a stirrup strap thereto;

a foot support pivotally mounted between the arms when the stirrup is in normal use, wherein the foot support comprises a tread having an extension projecting upwardly from each end of the tread, the distal ends of which extensions join to form a loop, wherein said pivotal mounting is by way of shafts and apertures within which said shafts extend; and co-operating engagement means between the foot support and the mounting member to retain the loop of said foot support in a plane generally coincident with a central plane of the mounting member when the stirrup is in said normal use, a wherein full disengagement of the foot support from the mounting member begins with rotation of said foot support from said normal in use position, in either direction relative to the mounting member, without any initial vertical movement of the foot support relative to the mounting member prior to said rotation, and wherein said shafts and said apertures are configured such that there is no said initial vertical movement of the foot support relative to the mounting member and disengagement only occurs upon the loop rotating through an angle of about 90 degrees relative to the central plane of the mounting member.

* * * * *